US010173855B2

(12) United States Patent
Oshiro et al.

(10) Patent No.: US 10,173,855 B2
(45) Date of Patent: Jan. 8, 2019

(54) SHEET CONVEYANCE APPARATUS AND IMAGE ERASING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Toshiaki Oshiro, Shizuoka (JP); Yuichi Saito, Shizuoka (JP); Tatsuhisa Naraoka, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 49 days.

(21) Appl. No.: 14/921,053

(22) Filed: Oct. 23, 2015

(65) Prior Publication Data

US 2017/0113892 A1 Apr. 27, 2017

(51) Int. Cl.
*B65H 31/20* (2006.01)
*B65H 1/04* (2006.01)
(Continued)

(52) U.S. Cl.
CPC ..... *B65H 31/20* (2013.01); *B41J 2/325* (2013.01); *B65H 1/04* (2013.01); *B65H 7/02* (2013.01);
(Continued)

(58) Field of Classification Search
CPC ..... B65H 1/00; B65H 2405/00; B65H 2405/1116; B65H 2405/112; B65H 2405/113; B65H 2405/114; B65H 2511/10; B65H 2511/12; B65H 2405/11425; B65H 2405/1144; B65H 31/00; B65H 31/20
(Continued)

(56) References Cited

U.S. PATENT DOCUMENTS 3,589,710 A * 6/1971 Yagi ..... G03B 27/14 271/171
5,366,216 A * 11/1994 Ahlvin ..... B41J 11/58 271/171
(Continued)

FOREIGN PATENT DOCUMENTS

JP 5-124737 * 5/1993

OTHER PUBLICATIONS

Machine translation of JP 5-124737.*

*Primary Examiner* — Thomas A Morrison
(74) *Attorney, Agent, or Firm* — Amin, Turocy & Watson LLP

(57) ABSTRACT

A sheet conveyance apparatus comprises a first sheet accommodation unit, a second sheet accommodation unit, a conveyance path and a controller. The first sheet accommodation unit and the second sheet accommodation unit are both provided with a movable guide plate which determines the size of an accommodated sheet. The conveyance path conveys a sheet between the first sheet accommodation unit and the second sheet accommodation unit. The controller carries out a control processing so as to change, in a case in which the accommodation size of the first sheet accommodation unit is changed, the accommodation size of the second sheet accommodation unit to be the same as that of the first sheet accommodation unit.

13 Claims, 12 Drawing Sheets

(51) Int. Cl.

| | |
|---|---|
| ***B65H 43/00*** | (2006.01) |
| ***B65H 43/02*** | (2006.01) |
| ***B65H 83/02*** | (2006.01) |
| ***B65H 7/02*** | (2006.01) |
| ***B41J 2/325*** | (2006.01) |
| *B41J 2/475* | (2006.01) |

(52) U.S. Cl.
CPC ..... *B65H 43/00* (2013.01); *B65H 43/02* (2013.01); *B65H 83/025* (2013.01); *B41J 2002/4756* (2013.01); *B65H 2405/115* (2013.01); *B65H 2405/12* (2013.01); *B65H 2405/15* (2013.01); *B65H 2405/324* (2013.01); *B65H 2405/3322* (2013.01); *B65H 2511/10* (2013.01); *B65H 2511/20* (2013.01); *B65H 2511/30* (2013.01); *B65H 2511/51* (2013.01); *B65H 2513/40* (2013.01); *B65H 2551/20* (2013.01); *B65H 2801/06* (2013.01)

(58) Field of Classification Search
USPC ..... 271/223, 224, 171
See application file for complete search history.

(56) References Cited

U.S. PATENT DOCUMENTS

| | | | | |
|---|---|---|---|---|
| 5,781,822 | A | 7/1998 | Nishiyama et al. | |
| 6,073,925 | A * | 6/2000 | Sato | B65H 7/02 271/171 |
| 6,334,388 | B1 * | 1/2002 | Kimura | B41L 13/06 101/116 |
| 6,401,606 | B1 * | 6/2002 | Sato | B41L 21/02 101/116 |
| 6,654,586 | B2 * | 11/2003 | Lyon | B65H 1/04 399/367 |
| 9,126,786 | B2 | 9/2015 | Taki | |
| 2003/0180078 | A1 * | 9/2003 | Lyon | B65H 1/04 399/367 |
| 2011/0065574 | A1 | 3/2011 | Taguchi et al. | |
| 2013/0271547 | A1 * | 10/2013 | Umetsu | B41J 11/0015 347/179 |
| 2014/0193183 | A1 * | 7/2014 | Endo | G03G 21/00 399/341 |
| 2015/0071668 | A1 * | 3/2015 | Katakura | G03G 15/2046 399/69 |

* cited by examiner

SHEET CONVEYANCE APPARATUS AND IMAGE ERASING APPARATUS

FIELD

Embodiments described herein relate generally to a technology for controlling sizes of sheets accommodated in a plurality of cassettes.

BACKGROUND

An image processing apparatus is known which comprises an image forming section for forming an image on a sheet and an image erasing section for erasing the image by heating the sheet. A plurality of cassettes is used in the image processing apparatus, including: a cassette in which a used sheet is accommodated, a cassette in which a sheet subjected to an erasing processing is accommodated and a cassette in which a new sheet is accommodated.

To conform to the sizes of a variety of sheets, each cassette is equipped with a mechanism by means of which the size of the sheet capable of being accommodated in the cassette can be manually changed. Further, in order to match the size of accommodated sheet with a cassette for accommodating a sheet prior to the erasing processing and a cassette for accommodating a sheet subjected to the erasing processing, a user manually adjusts to make the size of each cassette match with the size of the sheet.

However, if the user changes the size of the sheet accommodated in one of cassettes and then carries out a processing without changing the size of the sheet accommodated in other one of cassettes, then there is a case in which the non-matching of the accommodated sheets in size leads to a jam or the damage of a sheet.

DETAILED DESCRIPTION

In accordance with embodiments described herein, a sheet conveyance apparatus comprises a first sheet accommodation unit, a second sheet accommodation unit, a conveyance path and a controller. The first sheet accommodation unit and the second sheet accommodation unit are both provided with a movable guide plate which determines the size of the accommodated sheet. The conveyance path conveys a sheet between the first sheet accommodation unit and the second sheet accommodation unit. The controller carries out a control processing so as to change, in a case in which the accommodation size of the first sheet accommodation unit is changed, the accommodation size of the second sheet accommodation unit to be the same as that of the first sheet accommodation unit.

The image processing apparatus described hereinafter is provided with at least two cassettes, including: a cassette in which a used sheet (a sheet the image on which is to be erased for the recycle) is accommodated and a cassette in which a sheet subjected to an erasing processing is accommodated. If the size of one of cassettes accommodating the sheet (hereinafter referred to as accommodation size as needed) is changed, the image processing apparatus provided herein changes the accommodation size of the other one of cassettes to be the same as that of one of cassettes.

Each of embodiments is described below with reference to accompanying drawings.

First Embodiment

Figure 1:
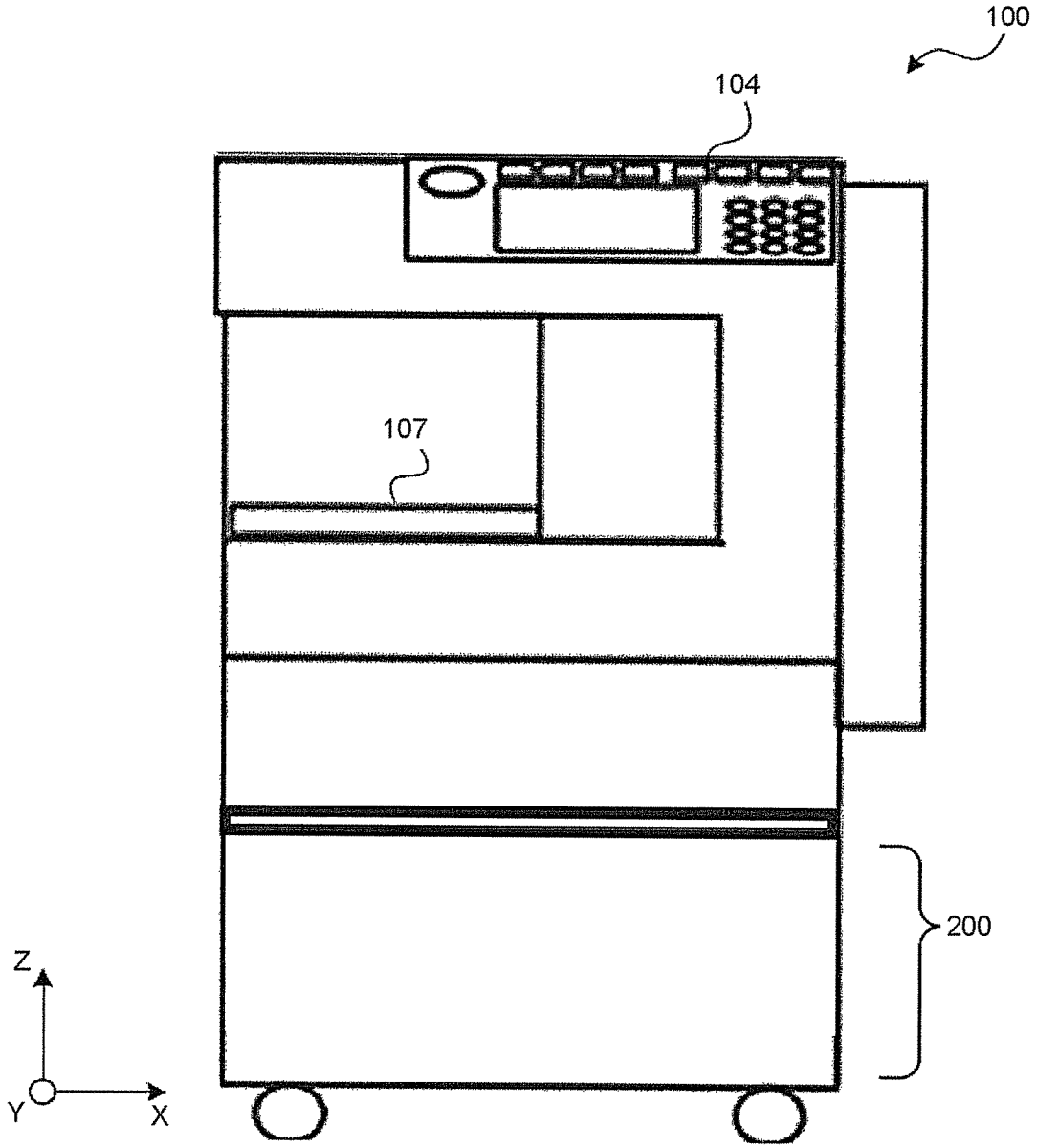
FIG. 1 is an external view of an image processing apparatus according to an embodiment.
Figure 2:
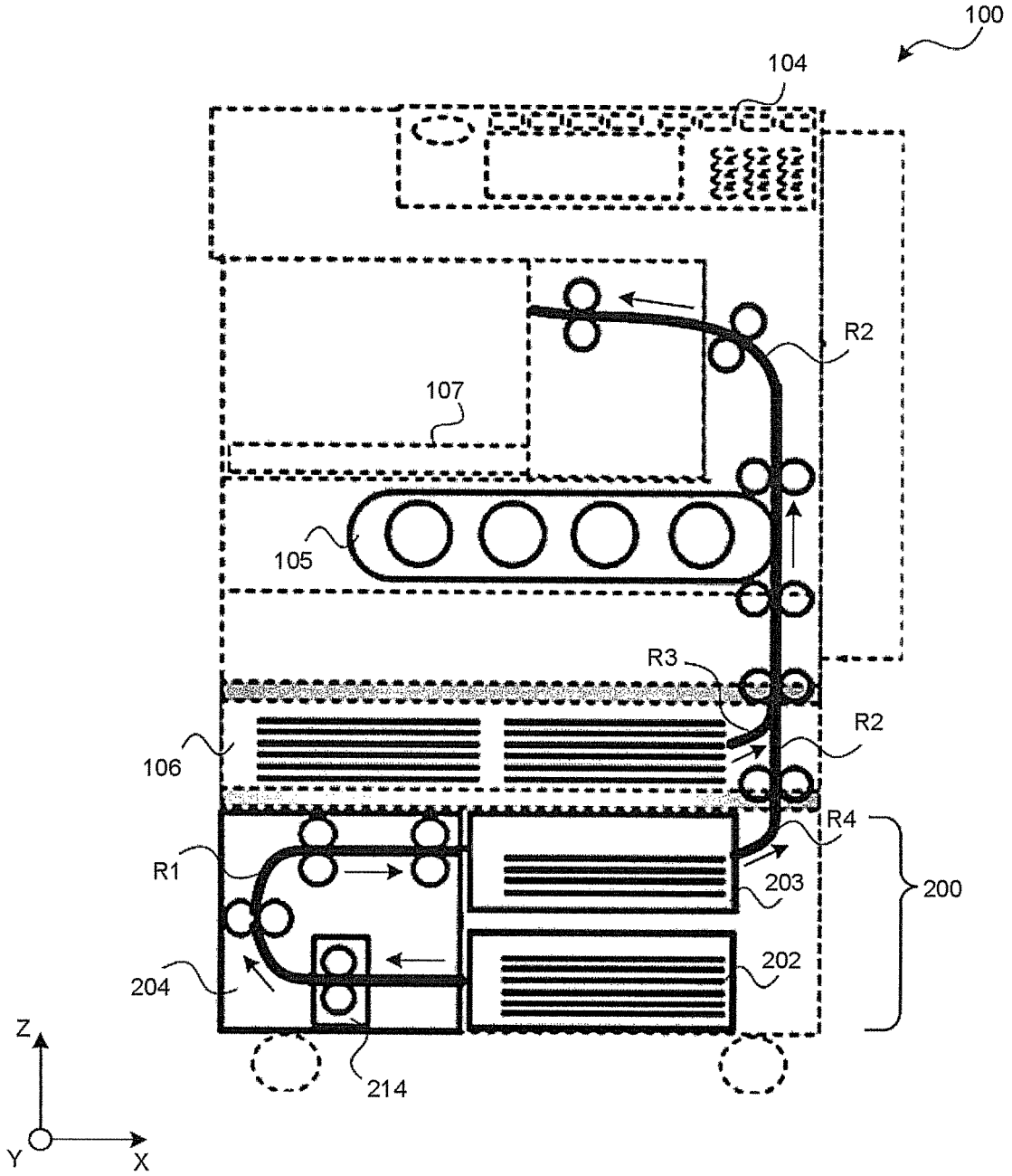
FIG. 2 is a schematic diagram exemplifying the internal structure of an image processing apparatus according to a first embodiment and a second embodiment.

FIG. 1 is an external view of an image processing apparatus according to an embodiment; and FIG. 2 is a schematic diagram exemplifying the internal structure of the image processing apparatus.

An image processing apparatus 100 comprises a new sheet cassette 106 which stacks and accommodates a new sheet, an image forming section 105 which forms an image on a sheet and a discharge tray 107 for stacking a sheet subjected to image formation. The image processing apparatus 100 comprises conveyance paths R2 and R3 which convey a sheet in the sequence of the new sheet cassette 106, the image forming section 105 and the discharge tray 107. Further, the image processing apparatus 100 comprises an operation panel 104 which receives input of a parameter value such as 'print copies' or a processing start instruction from the user and displays the progress status of a job.

An image erasing apparatus 200 is arranged at the lower part of a main body of the image processing apparatus 100. The image erasing apparatus 200 can be alternatively mounted on the main body of the image processing apparatus 100 or provided as an individual.

The image erasing apparatus 200 comprises a used sheet cassette 202 (sheet accommodation section), an erasing section 204 and a recycle sheet cassette 213 (sheet accommodation section). The used sheet cassette 202 accommodates a sheet which is used and to be recycled. That is, the used sheet cassette 202 accommodates a sheet on which an image is formed with a color material (toner or ink) which is decolorized at a temperature more than a specified temperature. The erasing section 204 heats, by using a heat source 214 at the forgoing temperature more than a specified temperature, the sheet fed from the used sheet cassette 202.

In this way, the erasing section 204 erases the image formed on the sheet. The recycle sheet cassette 203 stacks and accommodates the sheet for which the erasing section 204 carries out an erasing processing. Further, the 'decolorize' mentioned here means that an image which is formed with a color different from the fundamental color of a sheet (achromatic colors such as white and black in addition to chromatic colors) cannot be seen visually.

The image erasing apparatus 200 comprises a conveyance path R1 which conveys a sheet in the sequence of the used sheet cassette 202, the heat source 214 of the erasing section 204 and the recycle sheet cassette 213. Further, the image erasing apparatus 200 comprises a conveyance path R4 with one end connected with the conveyance path R2 in the main body of the image processing apparatus 100, and the other end connected with the recycle sheet cassette 203. If the image erasing apparatus 200 is optionally mounted on the main body of the image processing apparatus 100, then the conveyance path R2 can be connected with the conveyance path R4, and the sheet accommodated in the recycle sheet cassette 203 is also fed to the inside of the main body. Thus, the image processing apparatus 100 is capable of causing the image forming section 105 to form an image on a sheet fed from the recycle sheet cassette 203 and then discharging the sheet to the discharge tray 107 through the conveyance paths R4 and R2. The mounting of the image erasing apparatus 200 on the image processing apparatus 100 enables the image processing apparatus 100 to excuse a series of operations, including: erasing an image by using the erasing section 204 and forming an image on a sheet subjected to an image erasing processing by using the image forming section 105.

Figure 3:
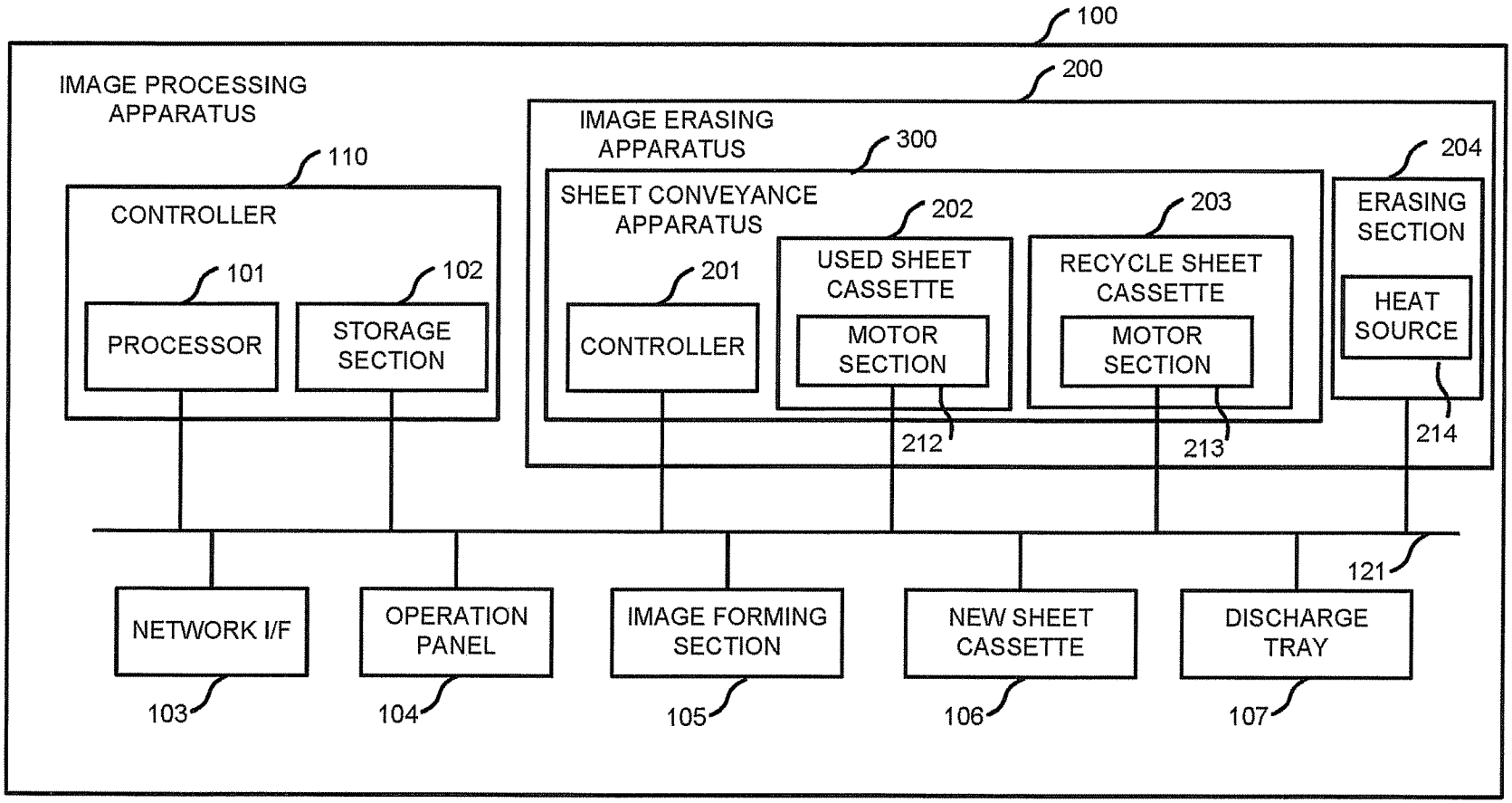
FIG. 3 is a block diagram exemplifying the structure of an image processing apparatus according to the embodiment.

FIG. 3 is a block diagram exemplifying the structure of the image processing apparatus 100 according to an embodiment. The image processing apparatus 100 comprises a processor 101 and a storage section 102. The processor 101 which is an arithmetic processing device such as a CPU (Central Processing Unit) executes the programs stored in the storage section 102 to realize various functions. The storage section 102 is a unit including a memory which stores data in a volatile manner and directly inputs/outputs data into/from the processor 101. Further, the storage section 102 is a unit including an ROM or auxiliary storage device which stores data in a nonvolatile manner. A structure consisting of the processor 101 and the storage section 102 functions as a controller 110 which collectively controls each internal unit of the image processing apparatus 100.

The image processing apparatus 100 comprises a network I/F 103 (I/F: interface) which receives a print job from a personal computer and returns a message indicating the result or status of a processing to the personal computer of the sending source according to an instruction from the controller 110. The image forming section 105, the new sheet cassette 106 and the discharge tray 107 shown in FIG. 3 are identical to those described above.

The image erasing apparatus 200 comprises a controller 201. The controller 201 is a unit which collectively controls each internal unit of the image erasing apparatus 200. In the present embodiment, it is assumed that the controller 201 is installed with an ASIC (Application Specific Integrated Circuit) having a storage area. But not limited to this, the controller 201 may also be a unit which has a processor and a storage section and carries out a control processing according to the data or program codes stored in the storage section. Further, the controller 110 of the image processing apparatus 100 may also take charge of the operations and the functions of the controller 201.

The used sheet cassette 202 comprises a motor section 212 for activating the machine mechanism shown in FIG. 4 described later. The recycle sheet cassette 203 also comprises a motor section 213 which is identical to the motor section 212.

Further, a device including the controller 201, the used sheet cassette 202 and the recycle sheet cassette 203 in the image erasing apparatus 200 and the conveyance path R1 shown in FIG. 2 functions as a sheet conveyance apparatus 300. The sheet conveyance apparatus 300 may also be provided as an individual.

Figure 4:
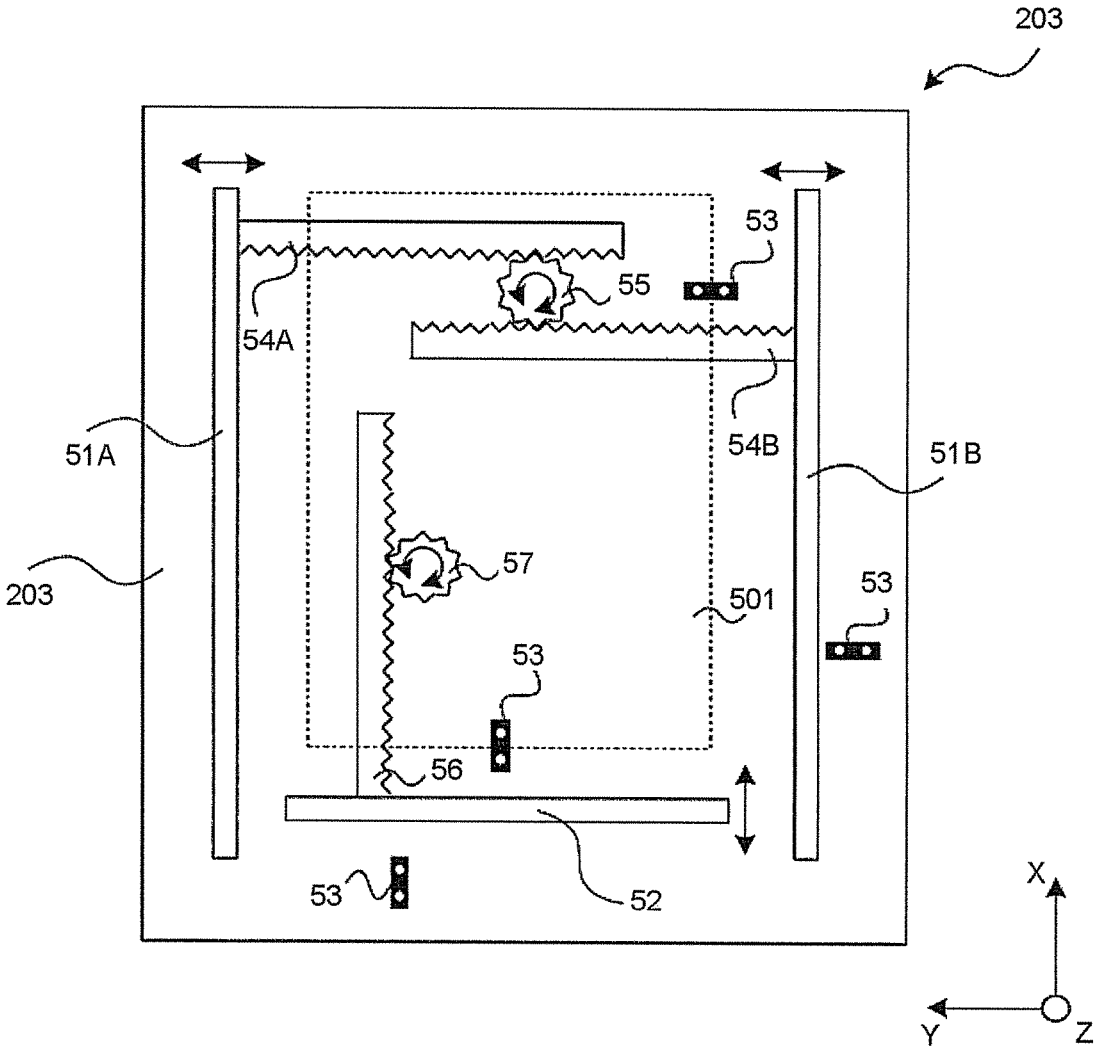
FIG. 4 is a schematic diagram exemplifying the structure of a cassette according to the first embodiment.

FIG. 4 is a diagram exemplifying the structure of the recycle sheet cassette 203 and particularly a diagram exemplifying a machine mechanism for changing the size of the accommodated sheet and a mechanism for detecting a sheet size and an accommodation size. The recycle sheet cassette 203 has a wall 51A and a wall 51B (guide plates) serving as guiders for aligning sheet bundles in a Y-axis direction. The wall 51A is jointed with a rack 54A serving as a linear gear, and the wall 51B is jointed with a rack 54B serving as a linear gear. In the Y-axis direction, the walls 51A and 51B are located at two sides of the area 501 where a sheet exists. The walls 51A and 51B approach or depart from each other by the rotation of a toothed pinion 55. If the pinion 55 rotates in the clockwise direction shown in FIG. 4, then the rack 54A engaged with the pinion 55 moves right, and the rack 54B moves left. The wall 51A moves right and the wall 51B moves left along with the pinion 55 so as to approach each other. If the pinion 55 rotates in the anticlockwise direction shown in FIG. 4, the rack 54A engaged with the pinion 55 moves left, and the rack 54B moves tight. The wall 51A moves left and the wall 51B moves right along with the pinion 55 so as to depart from each other.

The recycle sheet cassette 203 has a wall 52 (guide plate) serving as a guider for aligning sheet bundles in the X-axis direction. The wall 52 is jointed with a rack 56 serving as a linear gear. The wall 52 is moved upwards on the paper surface operating together with the rack 56 through the rotation of a pinion 57 in the clockwise direction shown in FIG. 4 and moved downwards on the paper surface operating together with the rack 56 through the rotation of the pinion 57 in the anticlockwise direction shown in FIG. 4.

Further, the pinions 55 and 57 obtain motive power from the motor section 213 to rotate clockwise or anticlockwise. The control of rotation start/stop and the rotational speed indicating how much degree of rotation of the motor section 213 follow an instruction signal from the controller 201. Further, the user may move the walls 51A, 51B and 52 manually.

Further, the recycle sheet cassette 203 comprises a plurality of size detection sensors 53. If the size detection sensor 53 is turned into "ON", it is deemed that there is a sheet above the sensor (the upper direction of the Z-axis direction, the front side of the paper surface). The size of the sheet can be detected by a combination of size detection sensors 53 in an 'ON' state. Further, the size detection sensor 53 is also 'ON' even when the walls 51A, 51B and 52 are located above the sensor (the upper direction of the Z-axis direction, the front side of the paper surface). Thus, in a case in which the user manually moves the walls 51A, 51B and 52, the size detection sensor 53 can also detect whether or not the accommodation size of the recycle sheet cassette 203 is changed for accommodating any sheet size. It is assumed that the sizes detectable to the size detection sensor 53 are standard sizes, for example, A4, Letter and A3.

The recycle sheet cassette 203 shown in FIG. 4 is described above; however, the used sheet cassette 202 is also equipped with the same size detection mechanism or machine mechanism.

Figure 5:
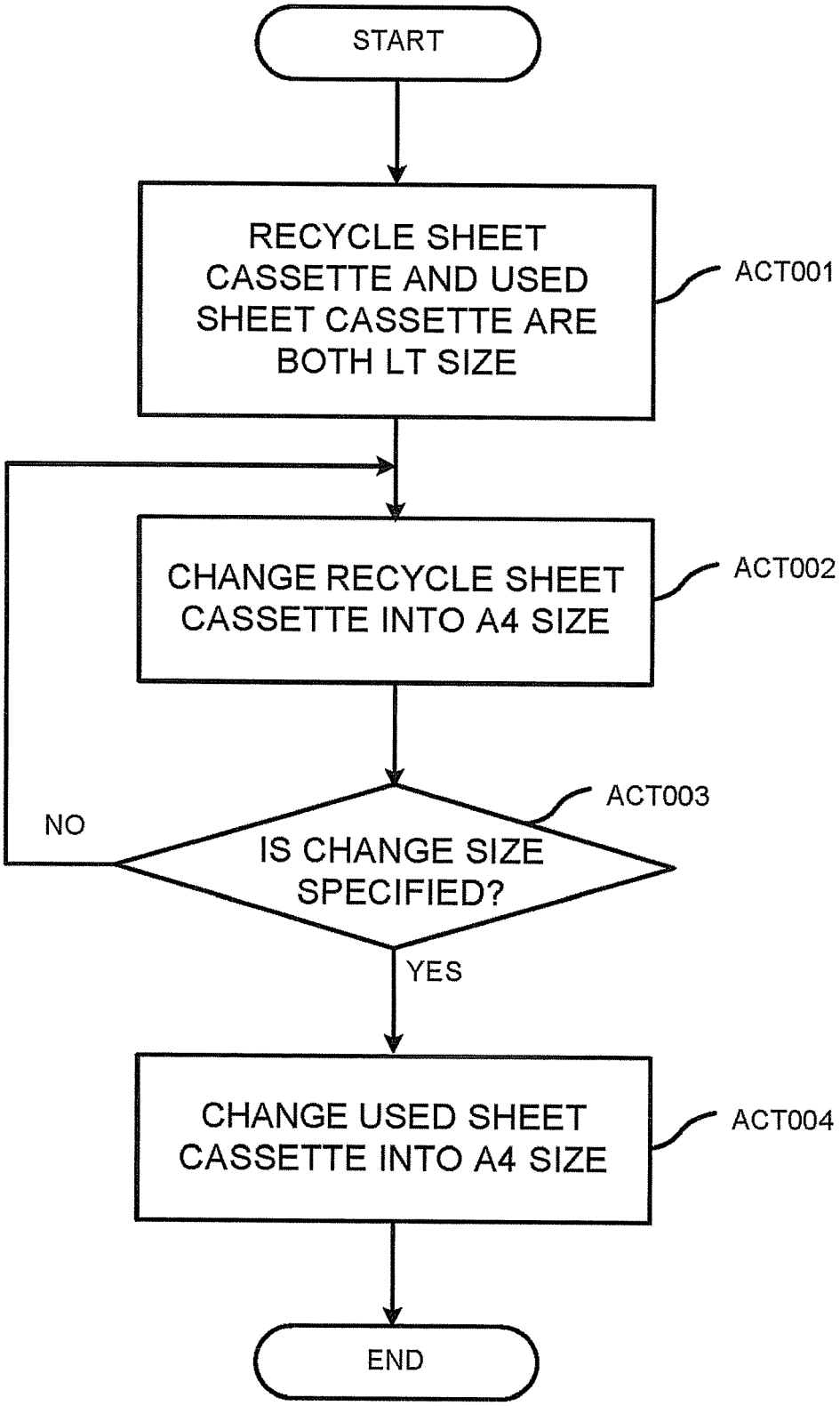
FIG. 5 is a flowchart exemplifying the operations carried out by the user to change the accommodation size of one of cassettes from LT (Letter) size to A4 size according to the first embodiment.
Figure 6:
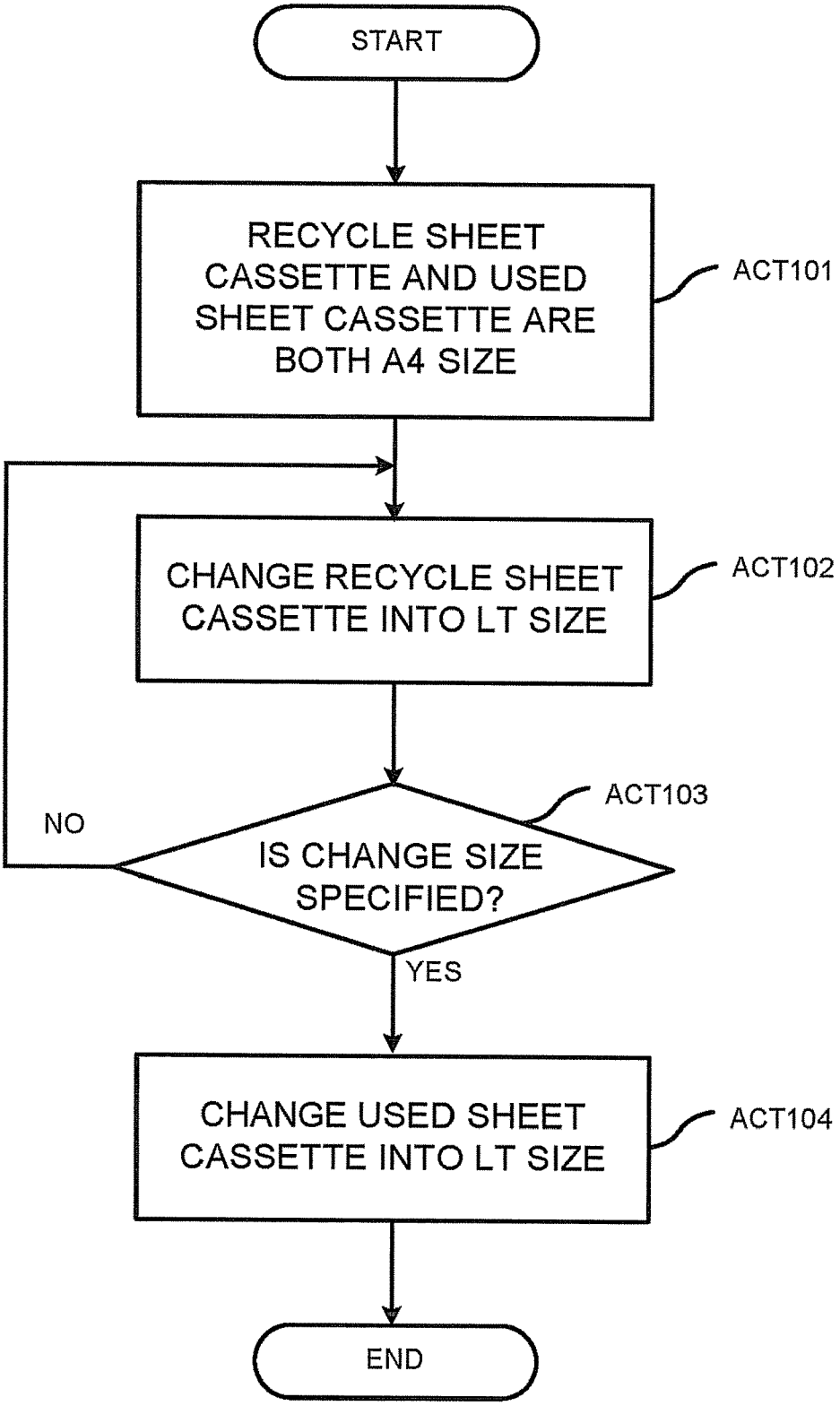
FIG. 6 is a flowchart exemplifying the operations carried out by the user to change the accommodation size of one of cassettes from A4 size to LT size according to the first embodiment.

FIG. 5 and FIG. 6 are flowcharts exemplifying the operations carried out in the first embodiment. FIG. 5 and FIG. 6 exemplify the operations of automatically changing, if a change of the accommodation size of the recycle sheet cassette 203 is detected, the size of the used sheet cassette 202 to be the same as the accommodation size of the recycle sheet cassette 203. FIG. 5 exemplifies the operations of changing the state of a letter size (LT size) to an A4 size, and FIG. 6 exemplifies the operations of changing the state of an A4 size to a LT size.

The operations illustrated in FIG. 5 are described first. Here, it is assumed that the user manually moves the walls of the recycle sheet cassette 203 to change the accommodation size of the recycle sheet cassette 203 to A4 size (ACT 002) when the accommodation sizes of the used sheet cassette 202 and the recycle sheet cassette 203 are both in a LT size state (ACT 001). The controller 201 determines whether or not walls are moved, that is, whether or not an accommodation size is changed, according to the 'ON'/'OFF' signal of the size detection sensor 53. Further, the controller 201 determines the accommodation size is changed to which one. (ACT 003). The controller 201 stands by until the change size is specified (ACT 003: Loop of No). If the change size is specified (ACT 003: Yes), the controller 201 activates the motor section 212 to change the accommodation size of the used sheet cassette 202 to be the same as that (A4 size) of the recycle sheet cassette 203 (ACT 004). By activating the motor section 212, the machine mechanism shown in FIG. 4 acts to change the accommodation size.

FIG. 6 exemplifies the operations carried out by the user to manually change the accommodation size of the recycle sheet cassette 203 from a state in which the accommodation sizes of the used cassette 202 and the recycle sheet cassette 203 are both A4 size (ACT 001) to LT size (ACT 102) used sheet cassette recycle sheet cassette. In this case, the controller 201 also specifies the changed accommodation size of the recycle sheet cassette 203 (ACT 103) and moves the walls 51A, 51B and 52 of the used sheet cassette 202 to change the accommodation size of the used sheet cassette 202 to be the same as LT size (ACT 104).

In the examples shown in FIG. 5 and FIG. 6, the controller 201 carries out a control processing to change, if the accommodation size of the recycle sheet cassette 203 is changed, the accommodation size of the used sheet cassette 202 to be the same as that of the recycle sheet cassette 203 and vice versa. That is, the controller 201 may carry out a control processing to change, if the accommodation size of the used sheet cassette 202 is changed, the accommodation size of the recycle sheet cassette 203 to be the same as that of the used sheet cassette 202.

According the first embodiment, it is assumed that after the accommodation size of one of cassettes is changed by the user, the accommodation size of the other one of cassettes is also changed to be the same as that of one of cassettes, thus inhibiting the occurrence of the jam and sheet damage caused by the non-matching of accommodation sizes.

Second Embodiment

For example, it is assumed that the user desires an erasing processing on an A4-sized sheet smaller than an A3-sized sheet in a case in which the accommodation sizes of the used sheet cassette 202 and the recycle sheet cassette 203 are both A3 size. At this time, the user manually changes the accommodation size of the used sheet cassette 202 from A3 size to A4 size. In this case, if an A3-sized sheet is loaded in the recycle sheet cassette 203 serving as the other one of cassettes, each wall is moved to form an A4 size smaller than an A3 size in the first embodiment, and thus, a problem occurs that the sheet in the recycle sheet cassette 203 is folded or corrugated.

In the second embodiment, an installation example of discharging the remaining sheets or notifying the user of the existence of the remaining sheets is described when the accommodation size of the other one of cassettes is changed while the remaining sheets exist in one of cassettes.

Figure 7:
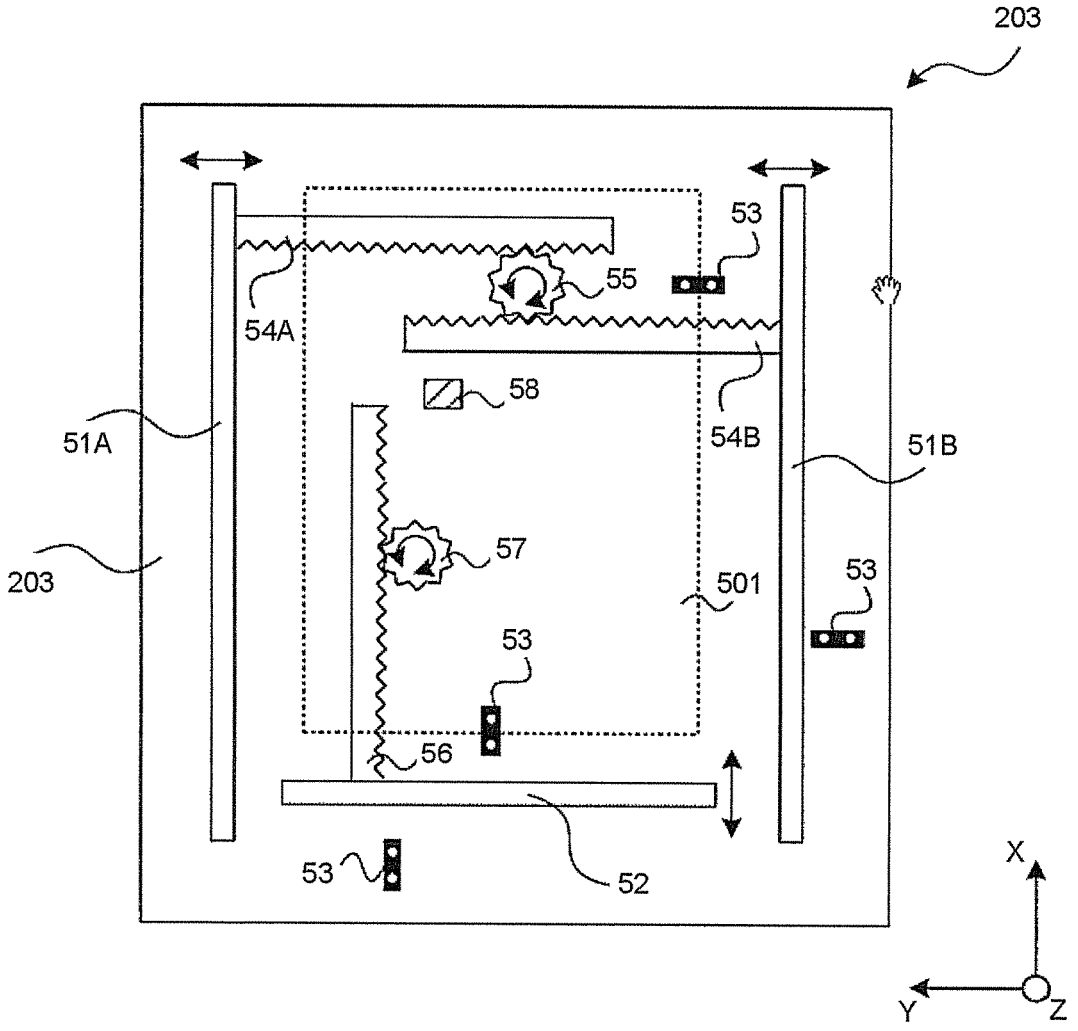
FIG. 7 is a schematic diagram exemplifying the structure of a cassette according to the second embodiment.

In the second embodiment, as shown in FIG. 7, the recycle sheet cassette 203 is also provided with a load detection sensor 58 in addition to the structure shown in FIG. 4. The load detection sensor 58 is arranged at a position where the load of sheets of any size can be detected. In the present example, the load detection sensor 58 is a weight sensor which detects the existence/absence of sheets and the quantity (weight, in the present example) of sheets if there are sheets. The controller 201 converts the detected weight into a number of sheets. An A4-sized sheet weighs about 4 g, and an A3-sized sheet weighs about 8 g, and thus, based on this, the controller 201 converts the detected weight into a number of sheets corresponding to a sheet size.

In the second embodiment, the used sheet cassette 202 is also equipped with a mechanism or a sensor which is identical to the structure shown in FIG. 7.

Figure 8:
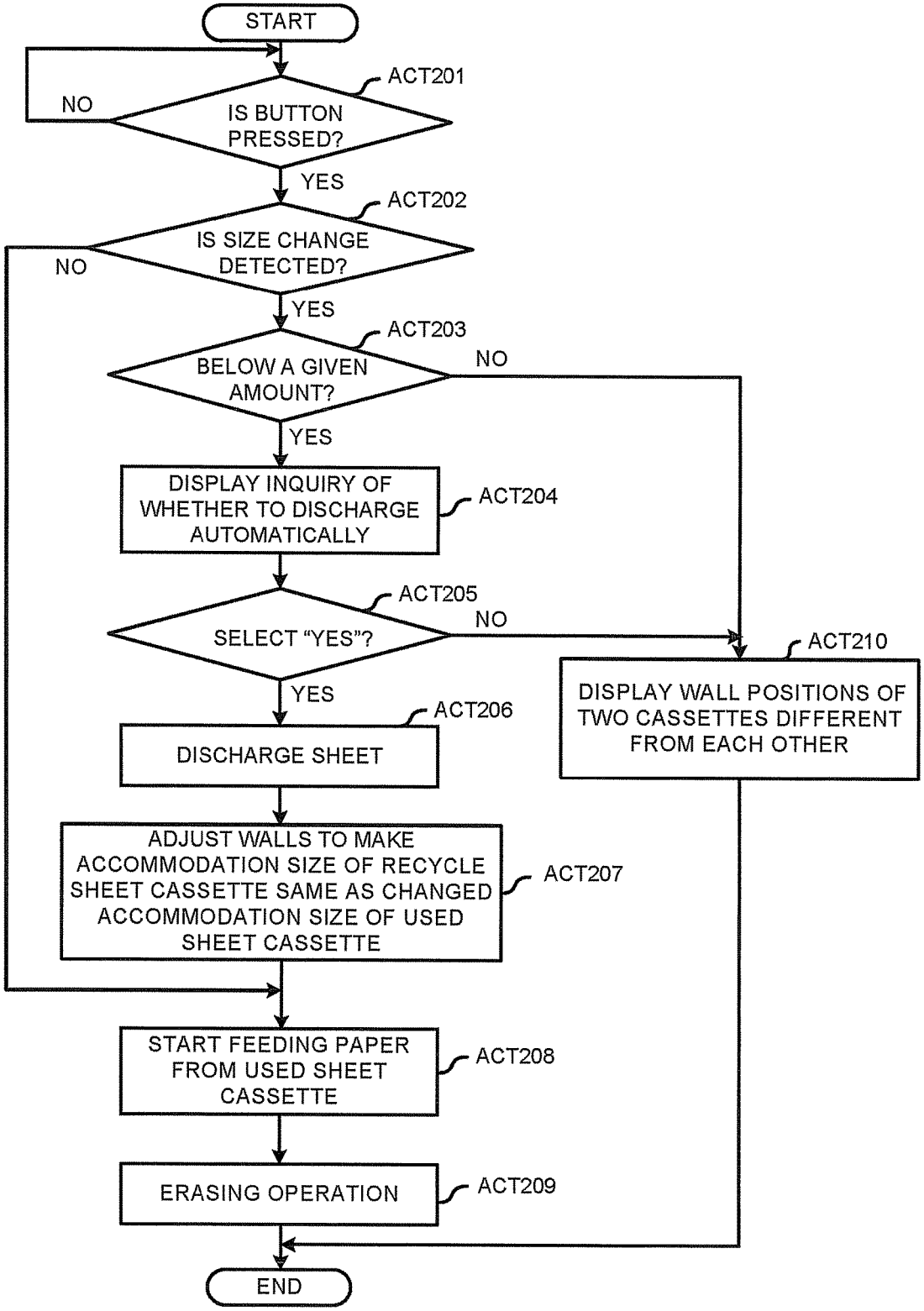
FIG. 8 is a flowchart, exemplifying the operations carried out according to the second embodiment.

FIG. 8 is a flowchart exemplifying the operations carried out in the second embodiment. In the present example, it is assumed that the size of the used sheet cassette 202 is changed by the user and the accommodation size of the recycle sheet cassette 203 is automatically changed along with the size change of the used sheet cassette 202.

The controller 110 determines whether or not a button 'start erasing' on the operation panel 104 is pressed (ACT 201). If the button 'start erasing' is pressed (ACT 201: Yes), the processing proceeds to ACT 202. Further, the operations subsequent to Act 202, although assumed in the present example to be carried out when the button 'start erasing' is pressed, are not limited to be triggered in this way. Further, a trigger signal is notified to controller 201.

The controller 201 determines whether or not the accommodation size of the used sheet cassette 202 is changed (ACT 202). In the case where the accommodation size of the used sheet cassette 202 is changed, the controller 201 also detects the changed accommodation size of the used sheet cassette 202 through the processing. In the case where the accommodation size of the used sheet cassette 202 is not changed (ACT 202: No), the controller 201 proceeds to execute the processing in ACT 208. In the case where the accommodation size of the used sheet cassette 202 is changed (ACT 202: Yes), the controller 201 determines whether or not there is a remaining sheet in the recycle sheet cassette 203 according to the value detected by the load detection sensor 58 of the recycle sheet cassette 203 and if so, determines whether or not there are a given quantity of remaining sheets in the recycle sheet cassette 203 (ACT 203). It is assumed that there may be an installation that the quantity mentioned here refers to a number of sheets for the comparison with a given number of sheets (e.g. 10); however, the detected weight is also applicable as it is, for comparison with a given weight (e.g. the weight of 10 sheets).

If the quantity is below the given quantity (ACT 203: Yes), the controller 201 activates the operation panel 104 to notify the existence of remaining sheets in the recycle sheet cassette 203 and synchronously inquire the user whether or not to discharge the remaining sheets automatically (ACT 204). Herein, if the user selects an automatic discharge (selects "Yes") (ACT 205: Yes), the controller 201 carries out a control processing so that the remaining sheets in the recycle sheet cassette 203 are all conveyed to the discharge tray 107 through the conveyance paths R4 and R2 (ACT 206).

Then, the controller 201 moves walls to change the accommodation size of the recycle sheet cassette 203 to be the same as the changed accommodation size of the used sheet cassette 202 (ACT 207). The controller 201 starts feeding the sheets from the used sheet cassette 202 (ACT 208) so that the erasing section 204 is operated to carry out a erasing processing (ACT 209).

On the other hand, if the result of ACT 203 is that the quantity is not below the given quantity (ACT 203: No), then it takes some time to discharge the remaining sheets as there are too many remaining sheets in the recycle sheet cassette 203. In this case, the controller 201 enables the operation panel 104 to display a message indicating that the walls of the two cassettes are located at different positions and a message 'remove manually' (ACT 210). Likewise, the message displayed in ACT 210 is displayed if the selection of the user in ACT 205 is No (ACT 205: No).

With such a structure, a jam or an alignment failure can be prevented which is caused by the difference in the location of the walls of the used sheet cassette 202 and the recycle sheet cassette 203.

Third Embodiment

In the third embodiment, the image processing apparatus 100 determines whether or not there is a sheet in the other one of cassettes after the user changes the accommodation size of one of cassettes. If there is a sheet in the cassette, the image processing apparatus 100 informs the user to remove the sheet. Further, if one of cassettes is slide or a cover for covering the cassette is detected to be opened or closed, the image processing apparatus 100 of the third embodiment changes the accommodation size of the other one of cassettes.

Figure 9:
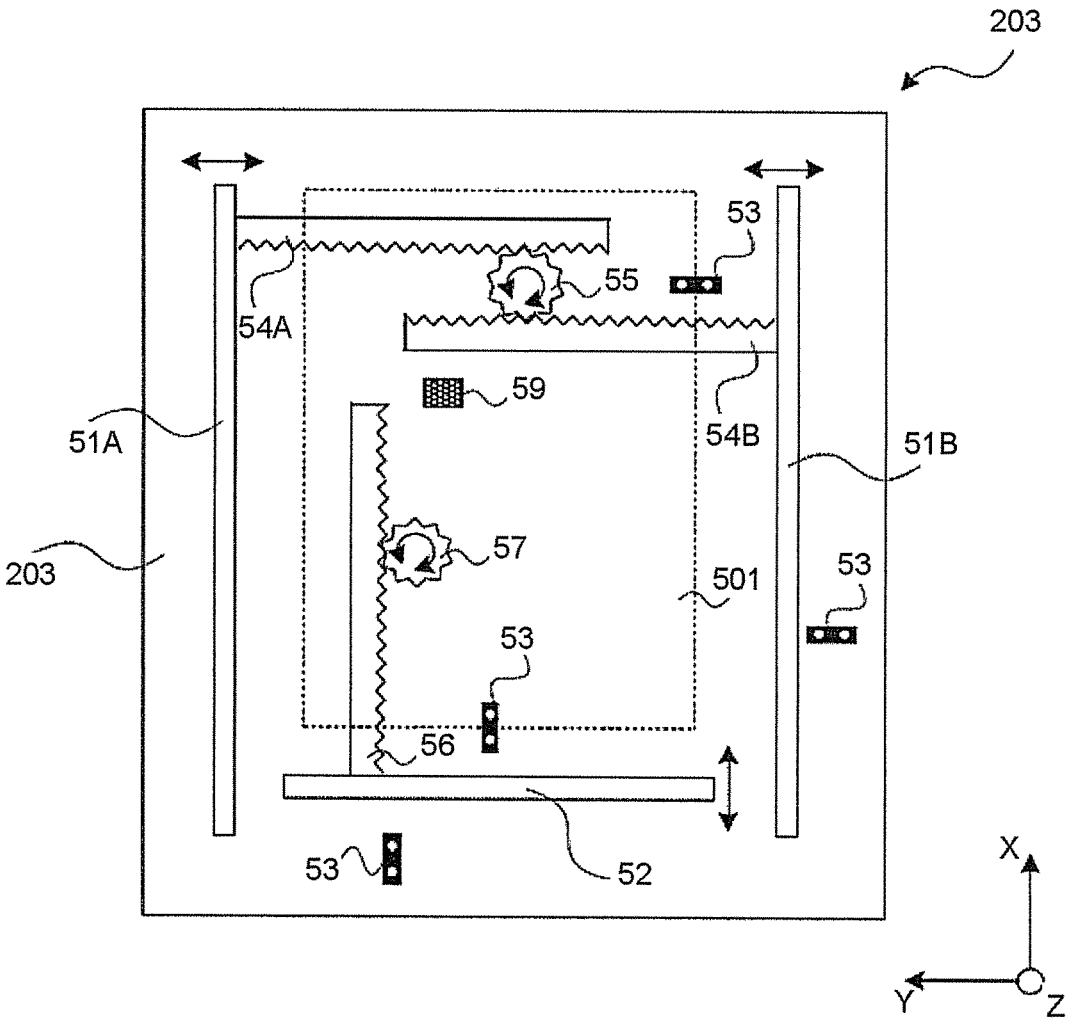
FIG. 9 is a schematic diagram exemplifying the structure of a cassette according to a third embodiment.

FIG. 9 is a diagram exemplifying the structure of the recycle sheet cassette 203 according to the third embodiment. It is assumed that the used sheet cassette 202 has the same structure with the recycle sheet cassette 203. In the third embodiment, the recycle sheet cassette 203 has a sheet detection sensor 59 for detecting whether or not there is an accommodated sheet. The sheet detection sensor 59 is arranged at a position where overlapped sheets of any size can be detected. In the present example, it is assumed that the sheet detection sensor 59 is a sensor which has a light emitting section and a light receiving section and which uses the attenuation in the amount of the light received by the light receiving section in a case in which there is a sheet between the light emitting section and the light receiving section. Further, the sheet detection sensor 59 may also be an infrared sensor, the load detection sensor 58 (weight sensor) used in the second embodiment, a physical switch which is turned on or off according to the weight of sheets.

Figure 10:
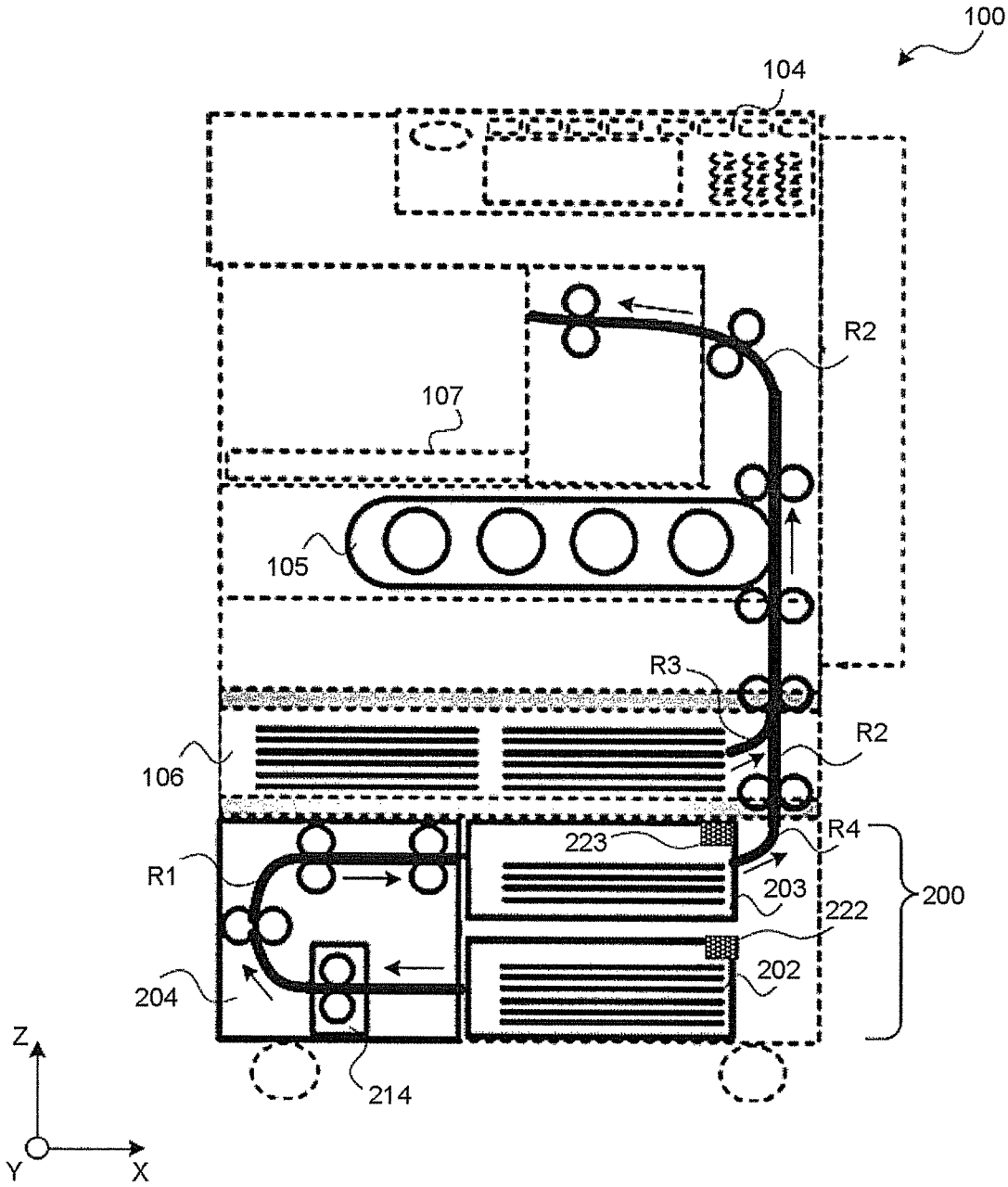
FIG. 10 is a schematic diagram exemplifying the internal structure of an image processing apparatus according to the third embodiment.

FIG. 10 is a schematic diagram exemplifying the internal structure of the image processing apparatus 100 according to the third embodiment. In the third embodiment, the image processing apparatus 100 further comprises: an opening and closing detection sensor 222 for detecting the opening and closing state of the external wall cover of the used sheet cassette 202 and an opening and closing detection sensor 223 for detecting the opening and closing state of the external wall cover of the recycle sheet cassette 203.

The opening and closing detection sensor 222 is equipped with a physical switch. The switch is in an 'OFF' state and outputs an "OFF" signal when the external wall cover is closed, and in an 'ON' state and outputs an "ON" signal when the external wall cover is opened. It is assumed that the opening and closing detection sensor 223 is also equipped with a physical switch. The switch may also be turned on/off when the external wall cover is closed/opened.

Further, it is assumed in the present example that the opening/closing of the external wall cover is detected, however, it is also applicable that the used sheet cassette 202 and the recycle sheet cassette 203, for example, are slide forwards in the Y-axis direction so that sheets can be taken out. In this case, the opening and closing detection sensors 222 and 223 may be installations for detecting whether or not the used sheet cassette 202 and the recycle sheet cassette 203 are slide. That is, the opening and closing, detection sensors 222 and 223 detect whether or not the internal side of a sheet accommodation section is exposed to the outside.

Figure 11:
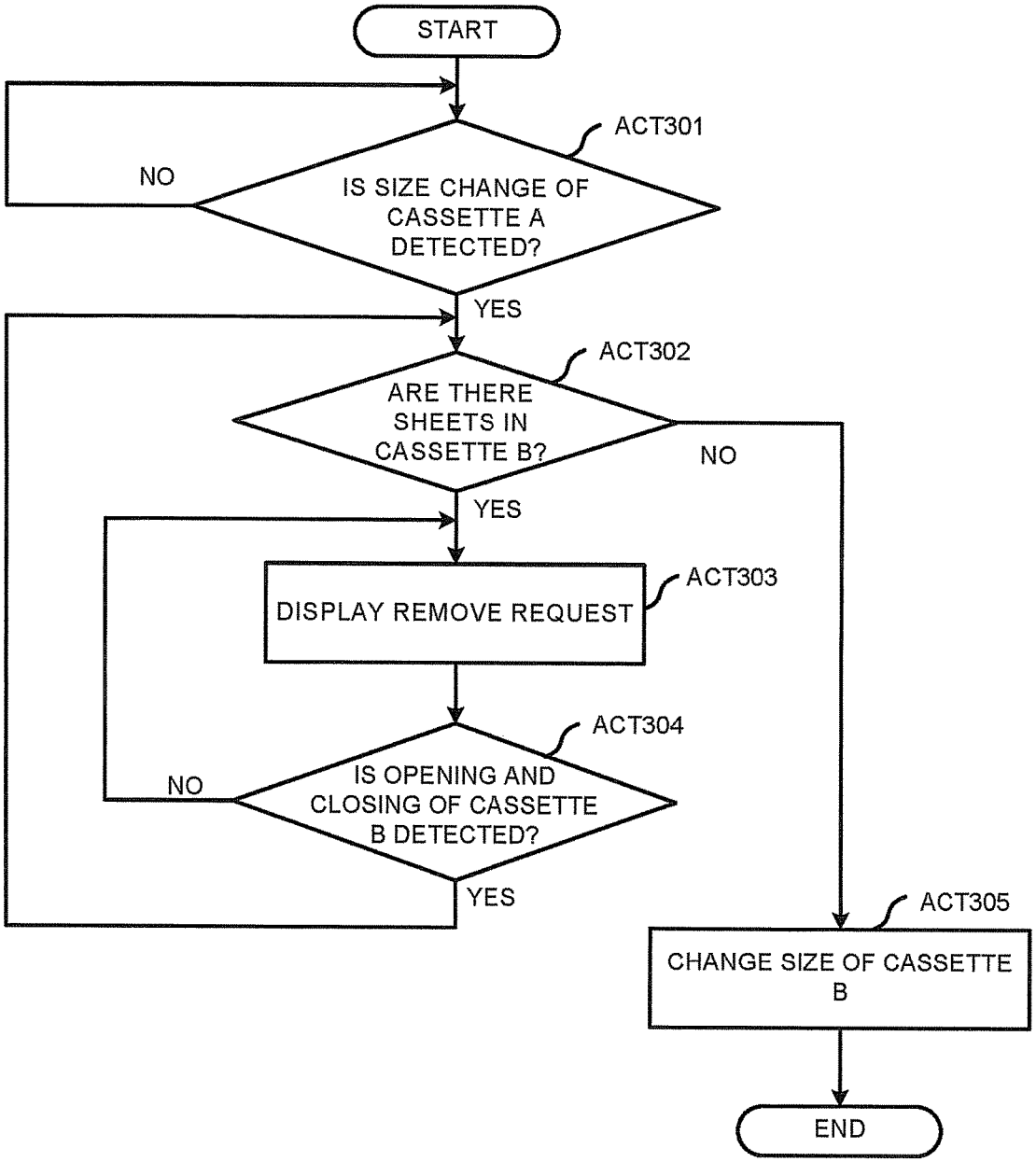
FIG. 11 is a flowchart exemplifying the operations carried out according to the third embodiment.
Figure 12:
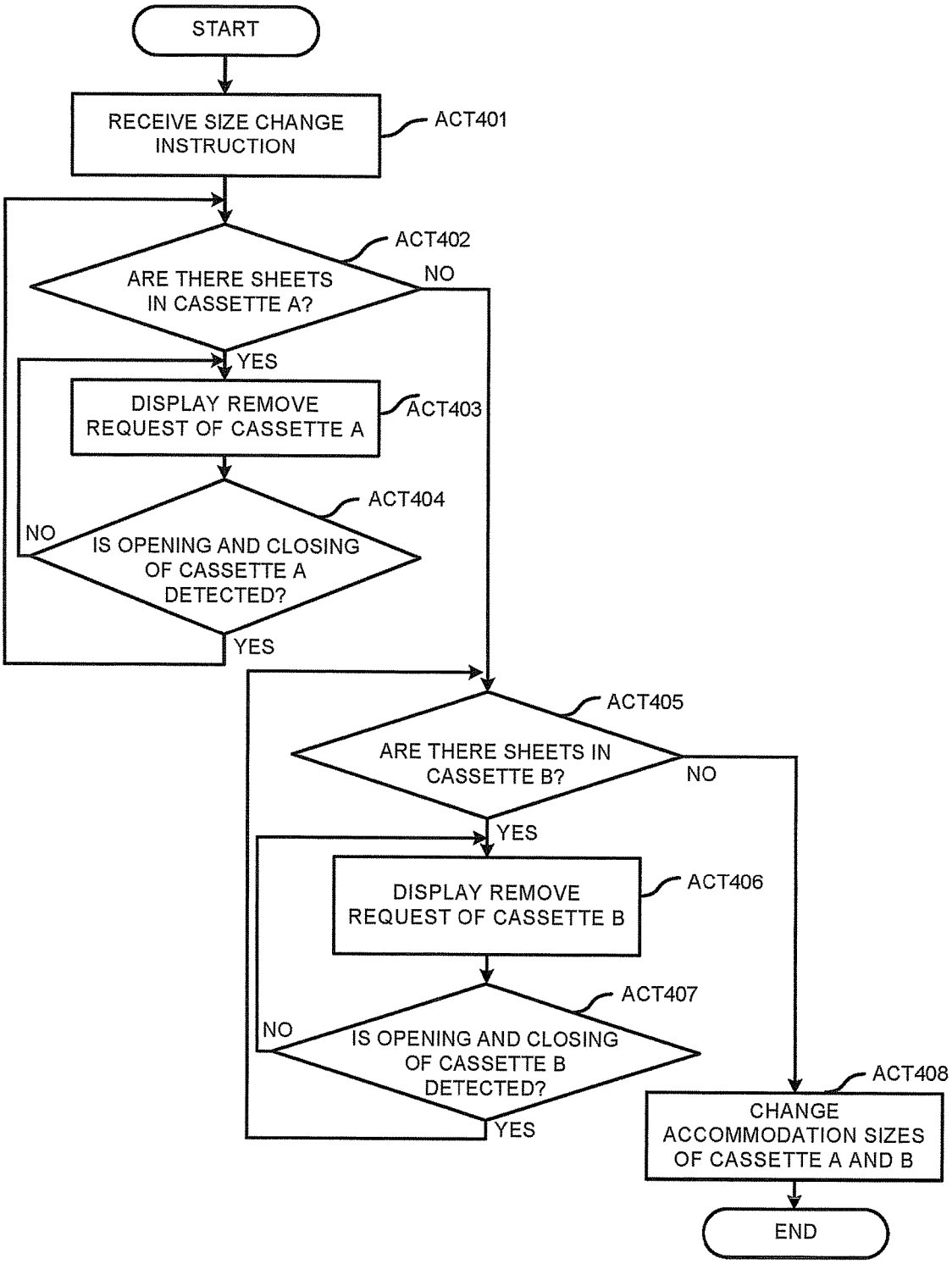
FIG. 12 is a flowchart exemplifying the operations carried out according to the third embodiment (a reception operation from an operation panel).

Next, the operations carried out in embodiment 3 are described with reference to the flowcharts of FIG. 11 and FIG. 12. In the flowcharts of FIG. 11 and FIG. 12, cassettes are marked as cassette A and cassette B. Herein, it is assumed that cassette A is the used sheet cassette 202 and cassette B is the recycle sheet cassette 203. It is also applicable that cassette A is the recycle sheet cassette 203 and cassette B is the used sheet cassette 202.

The flowchart of FIG. 11 is described. The controller 201 determines whether or not it is detected that the user manually changes the accommodation size of cassette A (ACT 301). The controller 201 determines whether or not the accommodation size of cassette A is changed according to the combination of the detection results of a plurality of size detection sensors 53. If the accommodation size of cassette A is changed (ACT 301: Yes), the controller 201 determines whether or not there is a sheet in cassette B according to an output signal from the sheet detection sensor 59 (ACT 302). If there is a sheet in cassette B (ACT 302: Yes), the controller 201 outputs a signal indicating the existence of a sheet to the controller 110. The controller 110 receiving the input of the signal controls the operation panel 104 to inform the user to remove the sheet accommodated in cassette B (ACT 303).

The controller 201 determines, according to a signal from the opening and closing detection sensor 223, whether or not opening and closing operation of cassette is carried out (ACT 304). In the present example, it is assumed that the determination result of ACT 304 is positive if cassette B is in the transition from an opened state to a closed state. If the determination result of Act 304 is negative (ACT 304: No), the processing returns to ACT 303 to inform the user to remove sheets. If the determination result of ACT 304 is positive (ACT 304: Yes), the processing returns to ACT 302 again and the controller 201 determines whether or not there is a sheet in cassette B (ACT 302).

Herein, if it is determined that the sheet in cassette B is removed or that there are no sheets in cassette B from the beginning (ACT 302: No), the controller 201 activates a machine mechanism to change the accommodation size of cassette B (ACT 305).

FIG. 12 is a flowchart exemplifying an operation of receiving a change instruction of accommodation size from the user through the operation panel 104. If the operation panel 104 receives the change instruction of accommodation size from the user (ACT 401), then the controller 110 outputs a specified signal to the controller 201. If the specified signal is input, the controller 201 determines whether or not there is a sheet in cassette A according to an output signal from the sheet detection sensor 59 (ACT 402). If there is a sheet in cassette A (ACT 402: Yes), the controller 201 outputs a specified instruction signal to the controller 110, and the controller 110 controls the operation panel 104 to inform the user to remove the sheet accommodated in cassette A (ACT 403). The controller 201 determines, according to a signal from the opening and closing detection sensor 222, whether or not opening and closing operation of the external wall cover of cassette A is carried out (ACT 404). In a case in which the external wall cover is changed from an opened state to a closed state (ACT 404: Yes), the controller 201 determines whether or not there is a sheet in cassette A again (ACT 402).

Herein, if it is determined that the sheet in cassette A is removed or that there are no sheets in cassette A from the beginning (ACT 402: No), the controller 201 sequentially determines whether or not there is a sheet in cassette B (ACT 405), informs the user to remove the sheet if there are sheets (ACT 406) and determines whether or not opening and closing operation of the cassette is carried out (ACT 407). ACTs 405-407 are identical to ACTs 402-404 in operations.

If there are no sheets in either cassette (ACT 405: No), the controller 201 changes the accommodation sizes of cassettes A and B (ACT 408). In this case, the controller 201 carries out a control processing to change the accommodation sizes of cassettes A and B to an accommodation size specified by the user with the operation panel 104 and to be the same as each other.

Further, in the description of the foregoing embodiments, the 'erasing processing' is described as the decoloring of the color of an image; however, the 'erasing processing' may also refer to the erasing of an image. That is, not limited to an apparatus for thermally decoloring the color of an image, the erasing apparatus of the present embodiments may also be, for example, an apparatus for decoloring the color of an image formed on a sheet by irradiating the sheet with light, or an apparatus for erasing an image formed on a special sheet, or an apparatus for removing (erasing) an image formed on a sheet. The erasing apparatus may be a structure which makes the image formed on a sheet invisible so that the sheet is reusable.

Each of modes described in the first to third embodiments may also be combined.

According to the embodiments, a control processing can be carried out to unify the accommodation sizes of a plurality of sheet accommodation sections, thus reducing the occurrence of the problems caused by the non-matching of accommodation sizes.

While certain embodiments have been described, these embodiments have been presented byway of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet conveyance apparatus, comprising:

a first sheet accommodation unit configured to include a movable guide plate for determining a size of a sheet accommodated therein;

a second sheet accommodation unit configured to include a movable guide plate for determining a size of a sheet accommodated therein and accommodate the sheet originally in the first sheet accommodation unit and fed thereto, and feed the sheet accommodated in the second sheet accommodation unit;

a third sheet accommodation unit configured to accommodate the sheet originally in the second sheet accommodation unit and fed thereto;

a sensor configured to be provided at the second sheet accommodation unit and detect whether or not the sheet is accommodated in the second sheet accommodation unit; and a first conveyance path configured to convey the sheet originally in the first sheet accommodation unit to the second sheet accommodation unit;

a second conveyance path configured to convey the sheet originally in the second sheet accommodation unit to the third sheet accommodation unit;

a display section configured to display a message to inquire about removal of any remaining sheets in the second sheet accommodation unit; and a controller configured to control:

the second sheet accommodation unit to change an accommodation size of the second sheet accommodation unit to be the same as that of the first sheet accommodation unit after feeding any remaining sheets in the second sheet accommodation unit toward the third sheet accommodation unit, the display section to display the message to inquire about removal of any remaining sheets in the second sheet accommodation unit, and the second conveyance path to discharge any remaining sheets in the second sheet accommodation unit toward the third sheet accommodation unit according to a removal instruction from a user in a case where there is a remaining sheet in the second sheet accommodation unit when the accommodation size of the first sheet accommodation unit is changed.

2. The sheet conveyance apparatus according to claim 1, wherein in the case where there is a remaining sheet in the second sheet accommodation unit when the accommodation size of the first sheet accommodation unit is changed, the controller enables the display section to display a message indicating the existence of the remaining sheet.

3. The sheet conveyance apparatus according to claim 1, wherein the sensor is a sensor for detecting the quantity of sheets; and the controller compares the quantity of remaining sheets detected by the sensor with a given quantity to determine whether or not to discharge the remaining sheets to the third sheet accommodation unit.

4. The sheet conveyance apparatus according to claim 3, wherein if the quantity of remaining sheets is above the given quantity, the controller enables the display section to display a message to prompt a user to take the remaining sheets out.

5. The sheet conveyance apparatus according to claim 3, wherein the controller carries out a control processing so that the remaining sheets are discharged to the third sheet accommodation unit if the quantity of the remaining sheets is below the given quantity.

6. The sheet conveyance apparatus according to claim 1, wherein the second sheet accommodation unit further comprises an opening and closing detection sensor for detecting whether or not an internal side of the second sheet accommodation unit is exposed to the outside; and the controller carries out a control processing so that the accommodation size of the second sheet accommodation unit is changed to be the same as that of the first sheet accommodation unit in a case in which the detection signal of the opening and closing detection sensor is shifted.

7. An image erasing apparatus, comprising:

a first sheet accommodation unit configured to include a movable guide plate for determining a size of a sheet accommodated therein;

a second sheet accommodation unit configured to include a movable guide plate for determining a size of a sheet accommodated therein;

a third sheet accommodation unit configured to accommodate the sheet originally in the second sheet accommodation unit and fed thereto;

a erasing section configured to erase an image formed on a sheet;

a first conveyance path which passes the erasing section and conveys the sheet originally in the first sheet accommodation unit to the second sheet accommodation unit;

a second conveyance path configured to convey the sheet originally in the second sheet accommodation unit to the third sheet accommodation unit;

a display section configured to display a message to inquire about removal of any remaining sheets in the second sheet accommodation unit;

a sensor configured to be provided at the second sheet accommodation unit and detect whether or not the sheet is accommodated in the second sheet accommodation unit; and a controller configured to control the second sheet accommodation unit to change an accommodation size of the second sheet accommodation unit to be the same as that of the first sheet accommodation unit after feeding any remaining sheets in the second sheet accommodation unit toward the third sheet accommodation unit, the display section to display the message to inquire about removal of any remaining sheets in the second sheet accommodation unit, and the second conveyance path to discharge any remaining sheets in the second sheet accommodation unit toward the third sheet accommodation unit according to a removal instruction from a user in a case where there is a remaining sheet in the second sheet accommodation unit when the accommodation size of the first sheet accommodation unit is changed.

8. The sheet conveyance apparatus according to claim 7, wherein in the case where there is a remaining sheet in the second sheet accommodation unit when the accommodation size of the first sheet accommodation unit is changed, the controller enables the display section to display a message indicating the existence of the remaining sheet.

9. The sheet conveyance apparatus according to claim 7, wherein the sensor is a sensor for detecting the quantity of sheets; and the controller compares the quantity of remaining sheets detected by the sensor with a given quantity to determine whether or not to discharge the remaining sheets to the third sheet accommodation unit.

10. The sheet conveyance apparatus according to claim 9, wherein if the quantity of remaining sheets is above the given quantity, the controller enables the display section to display a message to prompt the user to take the remaining sheets out.

11. The sheet conveyance apparatus according to claim 9, wherein the controller carries out a control processing so that the remaining sheets are discharged to the third sheet accommodation unit if the quantity of the remaining sheets is below the given quantity.

12. The sheet conveyance apparatus according to claim 7, wherein the second sheet accommodation unit further comprises an opening and closing detection sensor for detecting whether or not an internal side of the second sheet accommodation unit is exposed to the outside; and the controller carries out a control processing so that the accommodation size of the second sheet accommodation unit is changed to be the same as that of the first sheet accommodation unit in a case in which the detection signal of the opening and closing detection sensor is shifted.

13. A sheet conveyance apparatus, comprising:

a first sheet accommodation unit configured to include a movable guide plate for determining a size of a sheet accommodated therein;

a second sheet accommodation unit configured to include a movable guide plate for determining a size of a sheet accommodated therein and accommodate the sheet originally in the first sheet accommodation unit and fed thereto;

a third sheet accommodation unit configured to accommodate the sheet originally in the second sheet accommodation unit and fed thereto;

a first conveyance path configured to convey the sheet originally in the first sheet accommodation unit to the second sheet accommodation unit;

a second conveyance path configured to convey the sheet originally in the second sheet accommodation unit to the third sheet accommodation unit;

a display section configured to display a message to inquire about removal of any remaining sheets in the second sheet accommodation unit;

a sensor configured to be provided at the second sheet accommodation unit and detect whether or not the sheet is accommodated in the second sheet accommodation unit; and a controller configured to control the second sheet accommodation unit to change an accommodation size of the second sheet accommodation unit to be the same as that of the first sheet accommodation unit after feeding any remaining sheets in the second sheet accommodation unit to the second conveyance path, the display section to display the message to inquire about removal of any remaining sheets in the second sheet accommodation unit, and the second conveyance path to discharge the remaining sheets toward the third sheet accommodation unit according to a removal instruction from a user in a case where there is a remaining sheet in the second sheet accommodation unit when the accommodation size of the first sheet accommodation unit is changed.

* * * * *